US007903132B2

(12) United States Patent
Sako et al.

(10) Patent No.: US 7,903,132 B2
(45) Date of Patent: Mar. 8, 2011

(54) THERMAL PRINTHEAD

(75) Inventors: Teruhisa Sako, Kyoto (JP); Naofumi Kanei, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 197 days.

(21) Appl. No.: 12/305,290

(22) PCT Filed: Jun. 19, 2007

(86) PCT No.: PCT/JP2007/062263

§ 371 (c)(1),
(2), (4) Date: Dec. 17, 2008

(87) PCT Pub. No.: WO2007/148663

PCT Pub. Date: Dec. 27, 2007

(65) Prior Publication Data

US 2009/0174757 A1 Jul. 9, 2009

(30) Foreign Application Priority Data

Jun. 21, 2006 (JP) ..... 2006-171267
Jun. 22, 2006 (JP) ..... 2006-172346

(51) Int. Cl.
*B41J 2/335* (2006.01)

(52) U.S. Cl. ..... 347/203

(58) Field of Classification Search ..... 347/203
See application file for complete search history.

(56) References Cited

U.S. PATENT DOCUMENTS

| | | | | |
|---|---|---|---|---|
| 4,835,550 | A * | 5/1989 | Sato et al. | 347/203 |
| 6,236,423 | B1 * | 5/2001 | Yamaji | 347/203 |
| 6,445,402 | B1 * | 9/2002 | Kinjyo et al. | 347/200 |
| 7,443,409 | B2 | 10/2008 | Sako | |
| 2010/0066798 | A1 * | 3/2010 | Yamade et al. | 347/203 |

FOREIGN PATENT DOCUMENTS

| | | |
|---|---|---|
| JP | 62-193845 | 8/1987 |
| JP | 7-186429 | 7/1995 |
| JP | 2000-141729 | 5/2000 |
| JP | 2002-370397 | 2/2002 |
| JP | 2002-103661 | 4/2002 |
| WO | WO 2005/105462 | 11/2005 |

* cited by examiner

*Primary Examiner* — Huan H Tran
(74) *Attorney, Agent, or Firm* — Hamre, Schumann, Mueller & Larson, P.C.

(57) ABSTRACT

A thermal printhead (A1) includes an insulating substrate and a heating resistor element (3) formed on the substrate and elongated in the primary scanning direction. A plurality of electrodes are connected to the heating resistor element (3). The electrodes and the heating resistor element (3) are covered by a protective film (4). The protective film (4) includes a first layer (41), a second layer (42) and a third layer (43). The second layer (42) is porous and includes a plurality of pores (42*a*). The third layer (43) partially enters each of the pores (42*a*) so that the upper surface pf the protective film (4) is an irregular surface including a plurality or recesses (4*a*).

6 Claims, 5 Drawing Sheets

THERMAL PRINTHEAD

TECHNICAL FIELD

The present invention relates to a thermal printhead used for printing on e.g. thermal paper.

BACKGROUND ART

FIG. 7 shows an example of conventional thermal printhead (see Patent Document 1 given below). The illustrated thermal printhead X includes a substrate 91 and a heating resistor element 93 extending on the substrate in the primary scanning direction. The heating resistor element 93 is covered by a protective film 94. The heading resistor element 93 is connected to an electrode 92 and another electrode (not shown) whose polarity is opposite to that of the electrode 92. When current is applied to the heating resistor element 93 via these electrodes, heat is generated. The heat is transferred to thermal paper through the protective film 94, whereby an image or letter is formed on the thermal paper.

Patent Document 1: JP-A-7-186429

Generally, to enable clear printing, the surface of thermal paper is made smooth. Examples of such surfacing techniques include the application of coating agent to thermal paper. Conventionally, however, the thermal paper having a smooth surface tends to stick to the protective film 94 when pressed against the thermal printhead X. When such a phenomenon (called "sticking") occurs, the thermal paper cannot be smoothly slid relative to the thermal printhead X, which may result in deterioration in printing quality.

Moreover, the above-described coating agent is generally hydrophilic and tends to absorb moisture in the air. Thus, when the thermal paper is pressed against the protective film 94, the moisture which has been absorbed in the coating agent may seep out between the thermal paper and the protective film 94. Conventionally, such moisture also causes the sticking of the thermal paper to the protective film 94.

DISCLOSURE OF THE INVENTION

The present invention has been proposed under the circumstances described above. It is, therefore, an object of the present invention is to provide a thermal printhead which is capable of preventing sticking.

According to a first aspect of the present invention, there is provided a thermal printhead comprising a substrate and a heating resistor element formed on the substrate and elongated in the primary scanning direction. The thermal printhead further includes an electrode for applying current to the heating resistor element, and a protective film covering the heating resistor element and the electrode and including a contact surface for coming into contact with a recording medium. The contact surface of the protective film is made irregular to reduce contact area with the recording medium.

Preferably, the protective film includes a first layer directly covering the heating resistor element and the electrode, a second layer formed on the first layer, and a third layer formed on the second layer to come into contact with the recording medium. For instance, in this case, the first layer is made of glass, the second layer is made of porous glass including a plurality of pores, and the third layer is made of a water repellent material. The third layer partially enters each of the pores of the second layer.

Preferably, the third layer is made of polyimide resin.

In a thermal printhead according to a second aspect of the present invention, the protective film includes a first layer directly covering the heating resistor element and the electrode and a second layer formed on the first layer. The second layer comprises a plurality of projecting elements spaced from each other.

Preferably, each of the projecting elements has a rectangular cross section, and a diagonal of the rectangular cross section is parallel to the secondary scanning direction which is perpendicular to the primary scanning direction.

Preferably, in the thermal printhead according to the second aspect of the present invention, the protective film includes a third layer covering the second layer and having water repellency. For instance, in this case, the second layer is made of either of SiC and a composite material of C and SiC, whereas the third layer is made of polytetrafluoroethylene.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
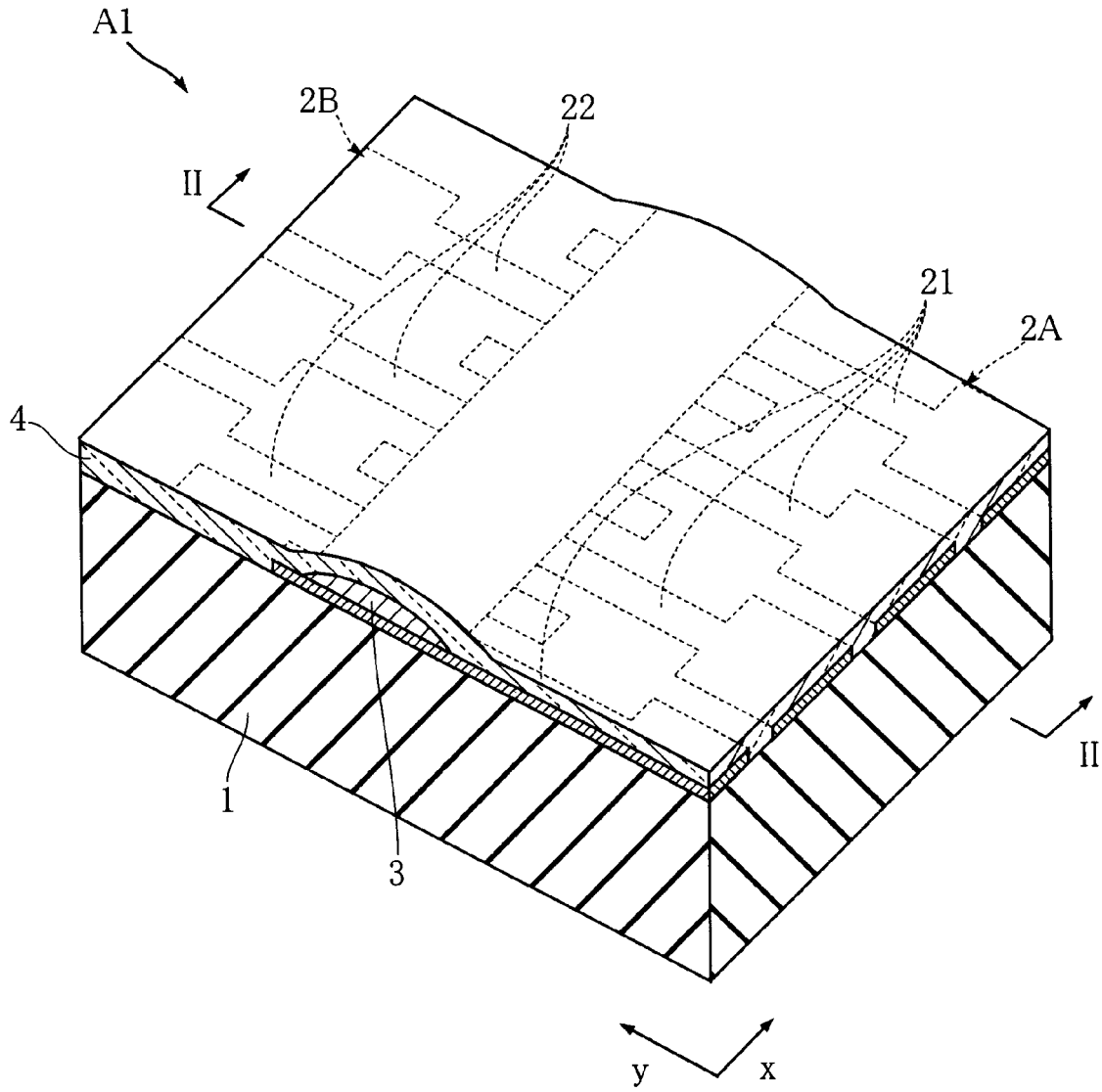
FIG. 1 is a perspective view showing a principal portion of a thermal printhead according to a first embodiment of the present invention.
Figure 2:
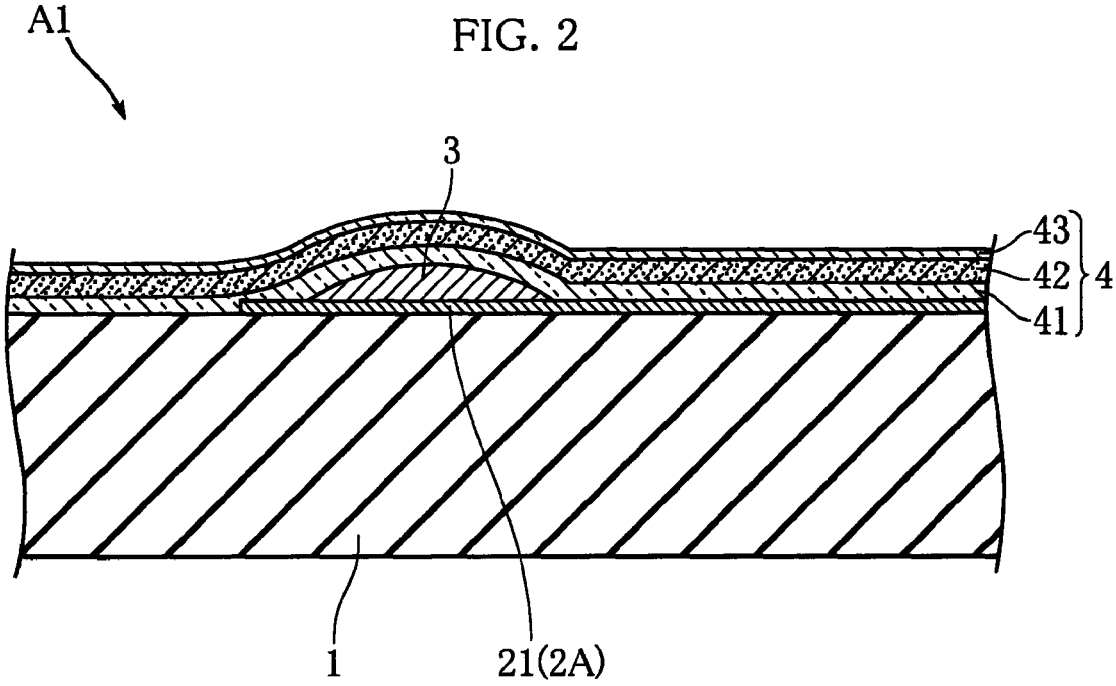
FIG. 2 is a sectional view taken along lines II-II in FIG. 1.
Figure 3:
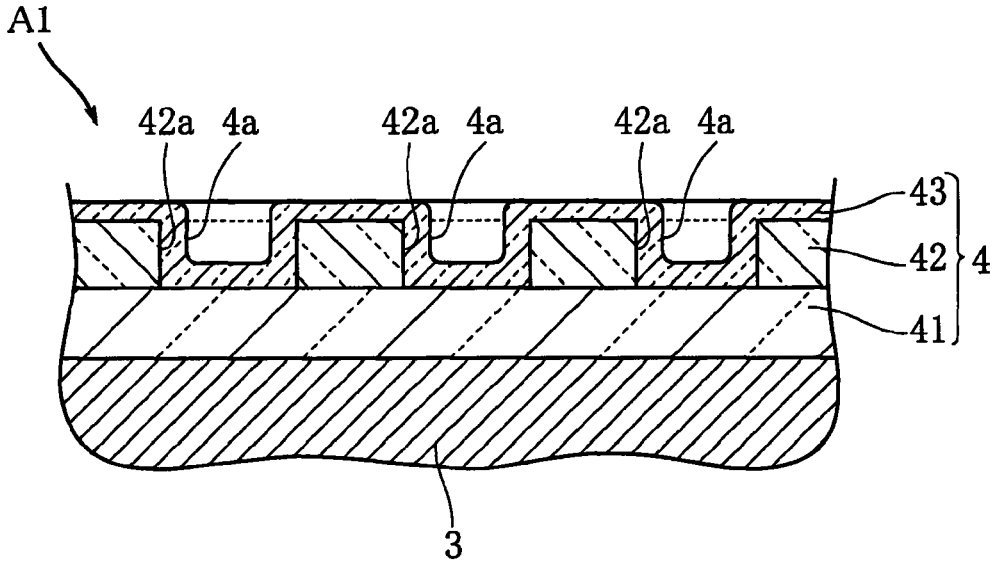
FIG. 3 is a sectional view showing the structure of a protective film of the thermal printhead of the first embodiment.

FIGS. 1-3 show a thermal printhead according to a first embodiment of the present invention. The illustrated thermal printhead A1 includes an insulating substrate 1, electrodes 2A and 2B, a heating resistor element 3 and a protective film 4. The heating resistor element 3 is elongated in the primary scanning direction (x direction in FIG. 1). In printing, recording paper such as thermal paper is transferred in the secondary scanning direction (y direction in FIG. 1) relative to the thermal printhead A1.

The substrate 1 is made of e.g. a ceramic material. A glaze layer (not shown) is formed on the substrate 1 to provide a smooth surface. The glaze layer also functions to prevent heat from escaping from the heating resistor element 3 to the substrate 1.

The electrodes 2A and 2B are made of a metal such as Au and have different electrical polarities. The electrode 2A includes a plurality of comb-teeth-shaped extensions 21 extending in the secondary scanning direction y, and the electrode 2B also has similar extensions 22. The extensions 21 and 22 are alternately arranged in the primary scanning direction x. The electrodes 2A and 2B are connected to a non-illustrated drive IC. The electrodes 2A and 2B may be formed by printing Au resinate paste into a predetermined shape and then baking the paste.

The heating resistor element 3 is made of e.g. ruthenium oxide. The heating resistor element 3 extends in the primary scanning direction to cross the extensions 21 and 22. In this arrangement, the heating resistor element 3 includes a plurality of portions (unit heating portions) each sandwiched between adjacent extensions 21 and 22. When current is applied to a selected one of the unit heating portions by the drive IC, the unit heating portion generates heat. Due to the heat, a region of the thermal paper corresponding to one dot is colored, whereby printing is performed. The heating resistor element 3 may be formed by printing paste containing ruthenium oxide into a predetermined shape and then baking the paste.

The protective film 4 protects the electrodes 2A, 2B and the heating resistor element 3. As shown in FIG. 2, the protective film 4 has a laminated structure made up of a first layer 41, a second layer 42 and a third layer 43. The first layer 41 is a dense layer directly covering the electrodes 2A, 2B and the heating resistor element 3 and made of e.g. glass. The first layer 41 has a thickness of e.g. about 4 μm. The first layer 41 is formed by printing glass paste containing $SiO_2$, $B_2O_3$ and PbO to cover the electrodes 2A, 2B and the heating resistor element 3 and then baking the paste. The softening point of the glass paste is e.g. about 680° C.

The second layer 42 is made of e.g. glass and laminated on the first layer 41. As shown in FIG. 3, the second layer 42 has a porous structure including a plurality of pores 42*a*. The thickness of the second layer 42 is e.g. about 4 to 6 μm. The diameter of the pores 42*a* is e.g. about several tens of μm. The second layer 42 may be formed as follows. First, conductive paste is uniformly printed on the first layer 41. As the conductive paste, use is made of a mixture of glass paste (base paste) containing $SiO_2$, ZnO, CaO as the main components and resistor paste. The resistor paste is prepared by adding 0.3 to 30 wt % of ruthenium oxide particles having a particle size of about 0.001 to 1 μm to glass made of e.g. PbO, $SiO_2$, $B_2O_3$. The softening points of the base paste and the resistor paste are 785° C. and 865° C., respectively. To form the second layer 42, the conductive paste is then baked at a temperature of e.g. 760° C. This baking temperature is lower than both of the softening temperature of the base paste and that of the resistor paste. Thus, the conductive paste does not flow considerably during the baking. In the baking process, bubbles are formed around the ruthenium oxide contained in the conductive paste. These bubbles finally form the pores 42*a*, whereby the porous second layer 42 is obtained.

As shown in FIG. 3, the third layer 43 covers the second layer 42 and portions of the first layer 41 which are not covered by the second layer 42. The third layer 43 is made of e.g. polyimide resin and has water repellency. The third layer 43 has a thickness of about 1 to 10 μm. Each pore 42*a* of the second layer 42 is filled with the third layer 43 at least partially. Due to the existence of the pores 42*a*, the upper surface of the third layer 43 (and hence the protective film 4) is not a smooth surface but an irregular surface including recesses 4*a* at locations corresponding to the pores 42*a*. The third layer 43 may be formed by printing or transferring a water-repellent resin onto the second layer 42.

The advantages of the thermal printhead A1 will be described below.

According to the embodiment described above, since the surface (which is to come into contact with paper) of the protective film 4 is formed with recesses 4*a*, the contact area between the protective film 4 and the thermal paper is small. As a result, the conventional problems of sticking and deterioration in printing quality are prevented. Further, by preventing the sticking, the feed speed of thermal paper (and hence the printing speed) can be increased.

Moreover, even when moisture which has been absorbed in the coating agent of the thermal paper seeps out, the moisture is retained in the recesses 4*a*. This prevents the protective film 4 and the thermal paper from strongly sticking to each other due to moisture. Particularly, the use of polyimide resin, which has water repellency, as the material of the third layer 43 is advantageous for preventing moisture from being retained at the contact portion between the protective film 4 and the thermal paper. Alternatively, as the material of the third layer 43, a material which has an appropriate level of water repellency and provides a smooth surface may be used instead of polyimide resin.

Figure 4:
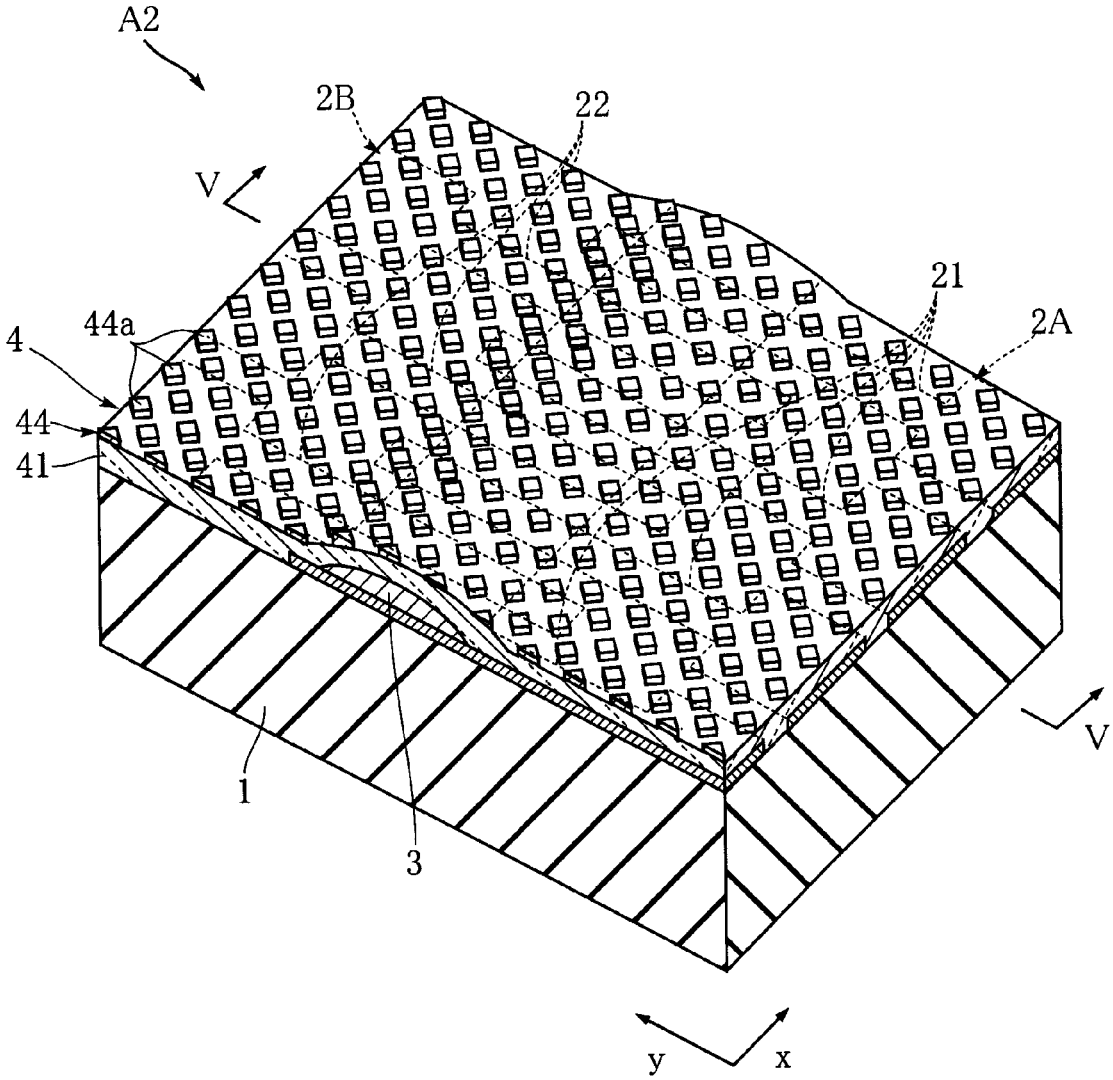
FIG. 4 is a perspective view showing a principal portion of a thermal printhead according to a second embodiment of the present invention.
Figure 5:
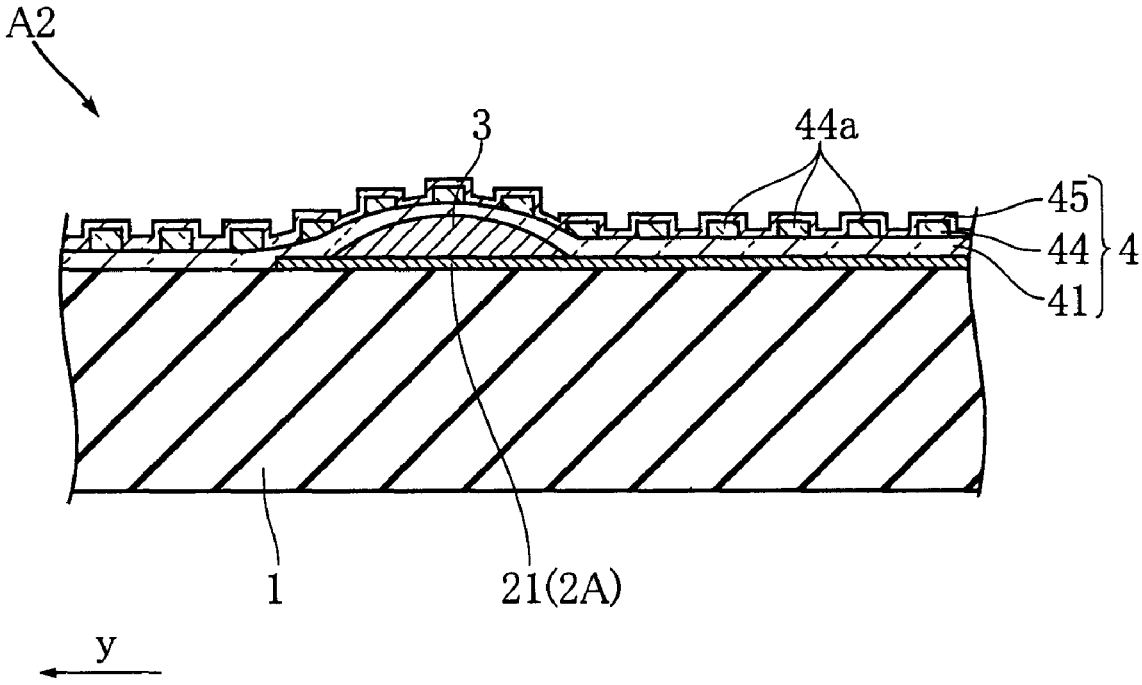
FIG. 5 is a sectional view taken along lines V-V in FIG. 4.
Figure 6:
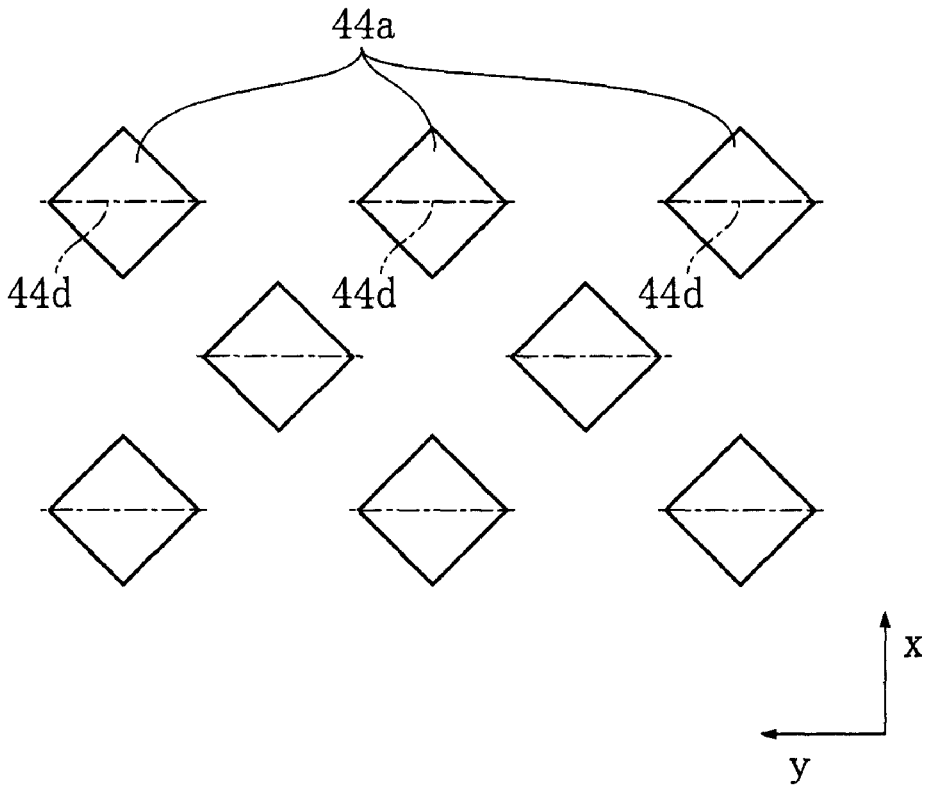
FIG. 6 is a plan view showing projecting elements of the thermal printhead according to the second embodiment.
Figure 7:
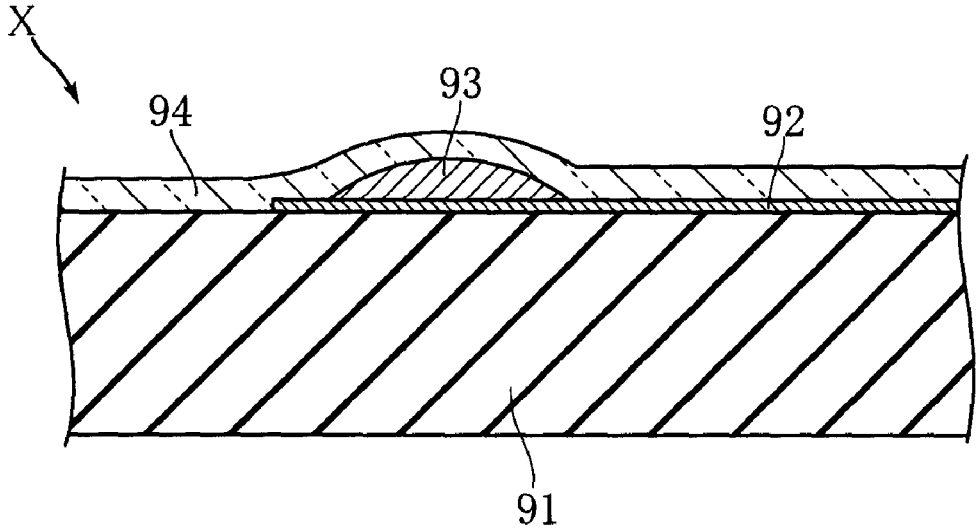
FIG. 7 PRIOR ART
FIG. 7 is a sectional view showing a principal portion of a conventional thermal printhead.

FIGS. 4-6 show a thermal printhead according to a second embodiment of the present invention. In these figures, the elements which are identical or similar to those of the first embodiment are designated by the same reference signs as those used for FIGS. 1-3.

As shown in FIGS. 4 and 5, the thermal printhead A2 according to the second embodiment includes an insulating substrate 1, electrodes 2A and 2B, a heating resistor element 3 and a protective film 4. The substrate 1 is made of e.g. a ceramic material. A non-illustrated glaze layer is formed on the substrate 1. The electrodes 2A and 2B are made of e.g. Au and include a plurality of extensions 21 and 22 extending in the secondary scanning direction y. The extensions 21 and 22 are alternately arranged in the primary scanning direction x. The heating resistor element 3 is made of e.g. ruthenium oxide. The protective film 4 protects the electrodes 2A, 2B and the heating resistor element 3 and has a laminated structure made up of a first layer 41, a second layer 44 and a third layer 45. The first layer 41 is a dense layer directly covering the electrodes 2A, 2B and the heating resistor element 3 and made of e.g. glass. The first layer 41 has a thickness of e.g. about 4 μm. The second layer 44 is made of SiC or a composite material (C—SiC) of C and SiC.

As shown in FIG. 4, the second layer 44 includes a plurality of projecting elements 44*a*. The projecting elements 44*a* are arranged to be spaced from each other in a plane including the primary scanning direction x and the secondary scanning direction y. Each of the projecting elements 44*a* is rectangular in horizontal cross section. As shown in FIG. 6, each projecting element 44*a* has a diagonal 44*d* which is parallel to the secondary scanning direction y. Each of the projecting elements 44*a* has a height of e.g. 4 to 6 μm. For instance, the second layer 44 may be made by forming a uniform film of the above-described material (SiC or C—SiC) by sputtering and then subjecting the film to patterning by etching. In another method, the portions of the first layer 41 on which the projecting elements 44*a* are not to be formed are covered by patterning a photosensitive resist. Then, a film of the above-described material is formed by sputtering to cover the photosensitive resist and the first layer 41. By subsequently removing the photosensitive resist, the second layer 44 including the projecting elements 44*a* is obtained.

As shown in FIG. 5, the third layer 45 covers the second layer 44 (i.e., the projecting elements 44*a*) and the upper surface of the first layer 41 (the portions which are not covered by the projecting elements 44*a*). The third layer 45 fills only part of the space between adjacent projecting elements 44*a* and does not fill the space completely. Thus, the surface (which is to come into contact with paper) of the protective film 4 is irregular. The third layer 45 is made of e.g. polytetrafluoroethylene (hereinafter referred to as "PTFE") and has water repellency. The thickness of the third layer 45 is e.g. about 2 to 3 μm. The third layer 45 may be formed by e.g. printing, transferring or sputtering.

In the thermal printhead A2 having the above-described structure, the contact area between the protective film 4 and the thermal paper is small, similarly to the first embodiment. This is advantageous for preventing the sticking. Although dust may be formed due to the rubbing between the protective film 4 and the thermal paper, such dust is retained in the space between adjacent projecting elements 44*a*. Thus, deterioration in printing quality is prevented.

In the thermal printhead A2, the diagonal 44*d* of each projecting element 44*a* is parallel to the secondary scanning direction y, and any side of the rectangular cross section is not parallel to the primary scanning direction x. Thus, the projecting element 44*a* comes into contact (via the third layer 45) with the thermal paper, which is being transferred in the secondary scanning direction y, from its apex. This is suitable for achieving smooth feed of the thermal paper.

Moreover, since the second layer 44 is made of SiC or C—SiC, the carbon content is relatively large. The larger the carbon content of a material is, the more likely PTFE, which forms the third layer 45, adheres to the material. Thus, the third layer 45 strongly adheres to the second layer 44. Further, since SiC and C—SiC has a high thermal conductivity, the heat from the heating resistor element 3 is efficiently transferred to the thermal paper. It is to be noted that, in the present invention, the third layer 45 of the protective film 4 according to the second embodiment can be eliminated. In this case, the projecting elements 44*a* constituting the second layer 44 directly come into contact with the thermal paper. In this variation, the formation density of the projecting elements 44*a* (i.e., the number of projecting elements per unit area) is so set that the thermal paper is not damaged by the projecting elements 44*a* when the paper is being transferred. Further, even when any of the projecting elements 42*a* has a defect (e.g. breakage or release from the first layer 41), it does not have an adverse effect on other projecting elements 42*a*.

The projecting elements 44*a* are not limited to those having a rectangular cross section. For instance, projecting elements which are polygonal or circular in cross section may be employed. The materials of the second layer 44 and the third layer 45 are not limited to those described above. For instance, the second layer 44 may be made of silane coupler, whereas the third layer 45 may be made of polyimide resin. The third layer 45 made of polyimide resin exhibits good water repellency and achieves smooth sliding relative to the thermal paper. Polyimide resin and silane coupler can be bonded strongly to each other.

The invention claimed is:

1. A thermal printhead comprising:

a substrate;

a heating resistor element formed on the substrate and elongated in a primary scanning direction;

an electrode for applying current to the heating resistor element; and a protective film covering the heating resistor element and the electrode and including a contact surface for coming into contact with a recording medium;

wherein the contact surface of the protective film is made irregular to reduce contact area with the recording medium; and wherein the protective film includes a first layer directly covering the heating resistor element and the electrode, a second layer formed on the first layer, and a third layer formed on the second layer to come into contact with the recording medium, the first layer being made of glass, the second layer being made of porous glass including a plurality of pores, the third layer being made of a water repellent material, the third layer partially entering each of the pores of the second layer.

2. The thermal printhead according to claim 1, wherein the third layer is made of polyimide resin.

3. A thermal printhead comprising:

a substrate;

a heating resistor element formed on the substrate and elongated in a primary scanning direction;

an electrode for applying current to the heating resistor element; and a protective film covering the heating resistor element and the electrode and including a contact surface for coming into contact with a recording medium;

wherein the contact surface of the protective film is made irregular to reduce contact area with the recording medium; and wherein the protective film includes a first layer directly covering the heating resistor element and the electrode and a second layer formed on the first layer, and wherein the second layer comprises a plurality of projecting elements spaced from each other.

4. The thermal printhead according to claim 3, wherein each of the projecting elements has a rectangular cross section, and wherein a diagonal of the rectangular cross section is parallel to a secondary scanning direction which is perpendicular to the primary scanning direction.

5. The thermal printhead according to claim 3, wherein the protective film includes a third layer covering the second layer and having water repellency.

6. The thermal printhead according to claim 5, wherein the second layer is made of either of SiC and a composite material of C and SiC, whereas the third layer is made of polytetrafluoroethylene.

* * * * *